US006189998B1

(12) United States Patent
Yanagi et al.

(10) Patent No.: US 6,189,998 B1
(45) **Date of Patent: *Feb. 20, 2001**

(54) SPACE SAVING INK JET RECOVERY DEVICE AND INK JET RECORDING APPARATUS USING THE SAME

(75) Inventors: Haruyuki Yanagi, Machida; Soichi Hiramatsu, Hachioji; Hiroyuki Kinoshita, Kawasaki; Hideaki Kawakami, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/417,223

(22) Filed: Apr. 5, 1995

(30) Foreign Application Priority Data

Apr. 8, 1994 (JP) ..... 6-095802
Mar. 30, 1995 (JP) ..... 7-073338

(51) Int. Cl.[7] ..... B41J 2/165
(52) U.S. Cl. ..... 347/33; 347/32
(58) Field of Search ..... 347/22, 23, 29, 347/30, 32, 33, 37, 92

(56) References Cited

U.S. PATENT DOCUMENTS 4,959,673 * 9/1990 Noda ..... 347/33
4,967,204 * 10/1990 Terasawa et al. ..... 347/23
5,138,343 * 8/1992 Aichi et al. ..... 347/30
5,148,203 * 9/1992 Hirano ..... 346/139 R
5,153,613 * 10/1992 Yamaguchi et al. ..... 347/30
5,202,702 * 4/1993 Terasawa et al. ..... 347/33
5,396,277 * 3/1995 Gast et al. ..... 347/33

FOREIGN PATENT DOCUMENTS 4000414 7/1991 (DE) .
0423475 4/1991 (EP) .
0494693 7/1992 (EP) .
0589604 3/1994 (EP) .
62-251146 * 10/1987 (JP) ..... 347/33
3-18847 * 1/1991 (JP) ..... 347/33
3-153360 * 7/1991 (JP) ..... 347/33

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A recovery device is described for use with a recording head of an ink jet recording apparatus. The recording head is mounted on a carriage which can reciprocate. The recovery device includes a cap for capping an ink discharge portion of the recording head when not in use, and a wiper for wiping out the ink discharge portion with a movement of the carriage. The wiper is disposed outside the cap relative to the recording area. The recording head does not pass through an area occupied by the wiper when the recording head performs a predischarge with respect to the cap during recording.

11 Claims, 13 Drawing Sheets

SPACE SAVING INK JET RECOVERY DEVICE AND INK JET RECORDING APPARATUS USING THE SAME

BACKGROUND OF THE INVENTION

1. Field of the Invention

The present invention relates to a recovery device and an ink jet recording apparatus provided with the recovery device, and more particularly to a recovery device disposed at a different location and an ink jet recording apparatus provided with the recovery device.

2. Related Background Art

Recording apparatuses which have features of printer, copying machine and facsimile, or are employed as the output device for composite equipment or workstation containing a computer, a word processor and so on, are configured to record the image (including characters or symbols) onto the recording sheet (recording medium) such as a paper or a plastic thin plate (e.g., OHP), based on image information. Such recording apparatuses can be classified into an ink jet system, a wire dot system, a thermal system, a thermal transfer system and a laser beam system, depending on the recording method for recording means used.

In a serial type recording apparatus which takes the recording system of scanning in a direction crosswise to the conveying direction of recording sheet (sub-scan direction), the image can be recorded on a desired range of the recording sheet in the manner, after setting the recording sheet at a predetermined recording position, to repetitively perform the operation of recording the image (including characters or symbols) by recording means (recording head) mounted on a carriage moving (scanning) along the recording sheet, the operation including recording one line, then feeding (sub-scanning) the sheet by a predetermined amount, and recording (scanning) the image at the next line. On the other hand, in a line type recording apparatus which performs the recording only by the sub-scanning of feeding the recording sheet in a conveying direction, the image is recorded over the recording sheet in the manner, after setting the recording sheet at a predetermined recording position, to consecutively perform the operation including recording one line at a time and feeding the sheet by a predetermined amount (pitch feeding).

Among them, an ink jet system (ink jet recording apparatus) which performs the recording by discharging the ink from recording means (recording head) onto the recording sheet has the advantages in which recording means can be made compact, the higher definition image can be recorded at higher speed, the ordinary paper is usable for recording without needs of any special treatment, the running cost is lower, there is less noise owing to the non-impact method, and the color image is readily recorded by using color inks. In particular, a line-type recording apparatus which uses recording means of the line type of having an arrangement of a number of discharge ports in a direction of the sheet width allows for the high speed recording.

Specifically, recording means (recording head) of the ink jet system of discharging the ink by the use of heat energy can be easily fabricated with an arrangement of liquid paths (discharge ports) at high density by forming electricity-heat converters, electrodes, liquid path walls, and a ceiling plate as the film on a substrate through a semiconductor fabrication process including etching, vapor deposition and sputtering, and thus can be made more compact. Also, by utilizing the merits of the IC technology or micro process technology, recording means can be easily constructed in longer size and planer form (two-dimensional form), and readily afforded a full-multi configuration or higher density packaging. On the other hand, there are a variety of demands for the material of recording sheet, and in recent years, in addition to the papers or resin thin films which are ordinary recording sheets, the use of thin papers or proposed papers (punched papers for filing or scored papers, or other papers of any shape) has been demanded.

In the ink jet recording apparatus, if the foreign matter such as paper powder or contaminant is stuck to the ink discharge portion of recording means (recording head), or the ink on the discharge port portion is dried, thickened and fixed therearound, the discharge ports may be clogged, resulting in a discharge failure (including undischarge). Thus, in order to prevent the clogging, the ink discharge portion is sealably closed with a cap when not in use, and a recovery device is utilized for recovering the ink discharge by sucking the ink from the discharge ports via the cap by suction means such as a pump. Note that in the serial type ink jet recording apparatus, the enclosing operation (capping operation) with the cap can be achieved in such a way as to move the recording head to a capping position provided outside the recording area, and place the cap into contact with the ink discharge portion located at the capping position.

Also, in the ink jet recording apparatus, cleaning means is provided for removing the foreign matter sticking to the ink discharge portion (discharge port face) of the recording head. An example of the cleaning means is a mechanism for cleaning (wiping) the discharge port face of the recording head with a pliable wiper (wiping member).

However, in the conventional cleaning means for the recording head, several technical problems have been posed as follows. Firstly, the recovery device including cleaning means has generally a complex constitution and many parts, thereby increasing the cost and making the apparatus larger. Secondly, because of the disposition of the wiper (wiping member) between the recording area and cap means, recording head may touch with the wiper every time of the capping operation or predischarge operation into the cap, for which a latch means to extend or retract the wiper is provided to avoid rubbing against the recording head face more than necessary, resulting in more complex constitution and causing greater noise. Note that a constitution for changing the contact force against the recording head without extending or retracting the wiper has been proposed, but it is undeniable that there is a risk that the flaw may occur on the recording head face. Thirdly, the use of a dedicated drive source for the contact and release between the cap and the recording head will give rise to a significant cost increase. Fourthly, when the capping operation is performed using the movement of carriage, the load on a carriage motor may be increased, thus requiring the carriage motor a size larger to be used, whereby there is much room for improvement in the respects of optimization and efficiency of the carriage motor. Further, fifthly, because the ink may be dispersed in separating the wiper away from the head after cleaning, it is necessary to secure a wider spacing between the recording area and the wiper to yield a dead space, which results in the larger apparatus. For example, there is a recovery mechanism as shown in FIG. 13 which makes effective use of this space. This has a recess portion 166 for receiving the ink for predischarge between the recording area and the wiper 185. And the cap 165 is more separated away from the recording area than the wiper 185 is. Therefore, the recovery device will require a space as wide as the length of $L_1$.

SUMMARY OF THE INVENTION

The present invention has been achieved in the light of the above-mentioned conventional arts, and an object of the invention is to simplify a recovery device including wiper means in the overall constitution to reduce the number of parts, the cost, and the size and weight, and enhance the reliability. Also, it is another object of the invention to provide an ink jet recording apparatus in which a latch mechanism for extending or retracting the wiping means can be omitted to reduce the factor of noise, and the contact between wiping means and recording means is allowed only when necessary to enhance the durability.

It is another object of the invention to provide an ink jet recording apparatus which is capable of optimizing a carriage motor by effecting the contacting and separating operation of capping means by the use of a driving power of recording sheet conveying means, thereby allowing for the efficient design.

As a result of examination to accomplish the above objects, the present inventors have attained a knowledge that a wiping member should be disposed outside capping means as viewed from the recording area. The present invention has been achieved based on this knowledge.

The invention 1 is intended to provide a recovery device and an ink jet recording apparatus with the recovery device mounted, the recovery device comprising capping means for capping an ink discharge portion of recording means when not in use, and wiping means for cleaning the ink discharge portion of recording means with the movement of carriage means, wherein wiping means is disposed outside capping means relative to the recording area with carriage means.

Another invention is intended to provide a recovery device and an ink jet recording apparatus with he recovery device mounted, the recovery device comprising capping means for capping an ink discharge portion of recording means when not in use, and wiping means for cleaning the ink discharge portion of recording means with the movement of carriage means which is reciprocable with recording means mounted thereon, wherein wiping means wipes out recording means in the reciprocal directions of carriage means, and wherein wiping means and recording means are relatively separated by the movement of the carriage means, when the carriage means is reversed in the moving direction, and then the wiping means is reversed in the direction of contact with the recording means.

Also, it is a further object of the invention to provide a recovery device and an ink jet recording apparatus with the recovery device mounted, the recovery device comprising capping means for capping an ink discharge portion of recording means when not in use, and wiping means for wiping out the ink discharge portion of recording means with the movement of carriage means which is scanned with recording means mounted thereon, wherein wiping means is disposed outside capping means relative to the recording area, and wiping means is caused to separate from recording means with the movement of the carriage means, before the contact state of the wiping means with the ink discharge portion of said recording means is released.

DETAILED DESCRIPTION OF THE PREFERRED EMBODIMENTS

Figure 1:
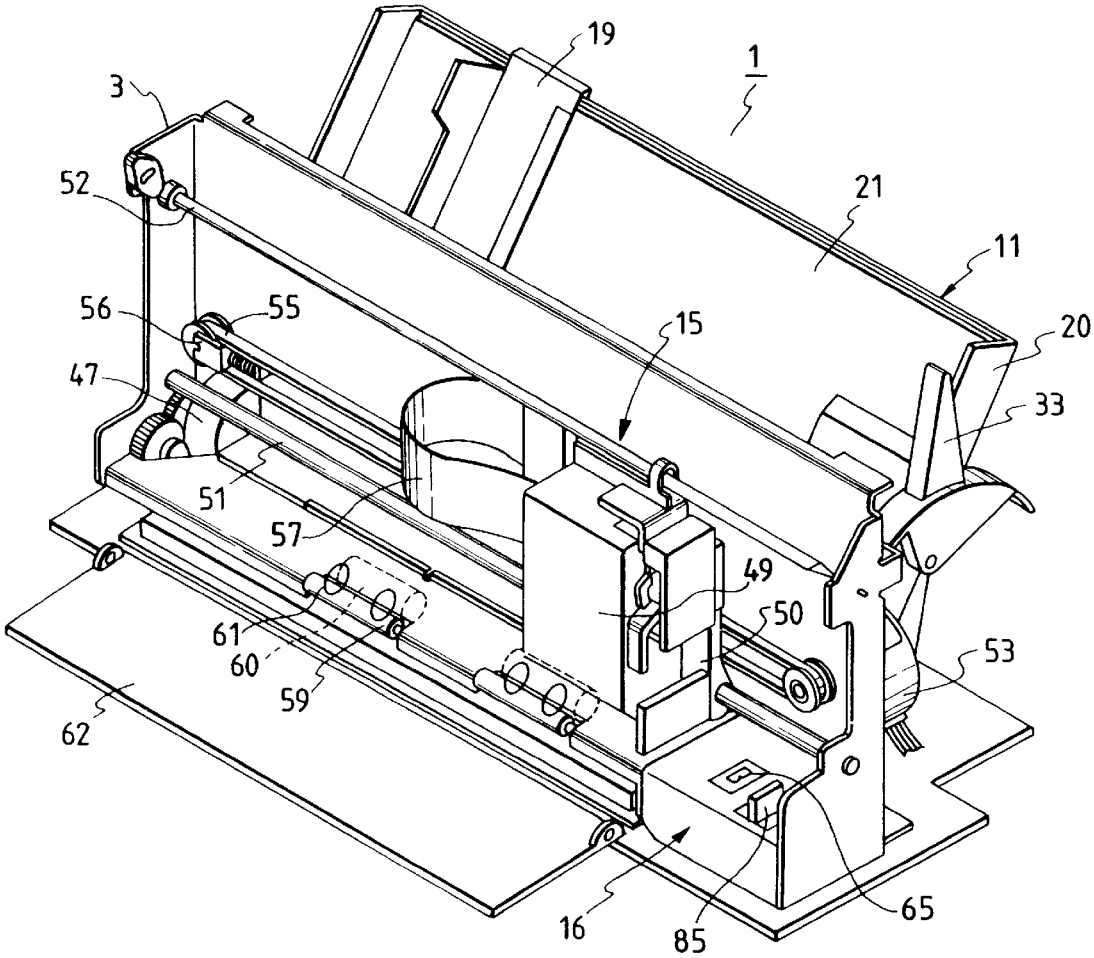
FIG. 1 is a perspective view schematically showing the essential constitution of an example of an ink jet recording apparatus to which the present invention is applied.
Figure 2:
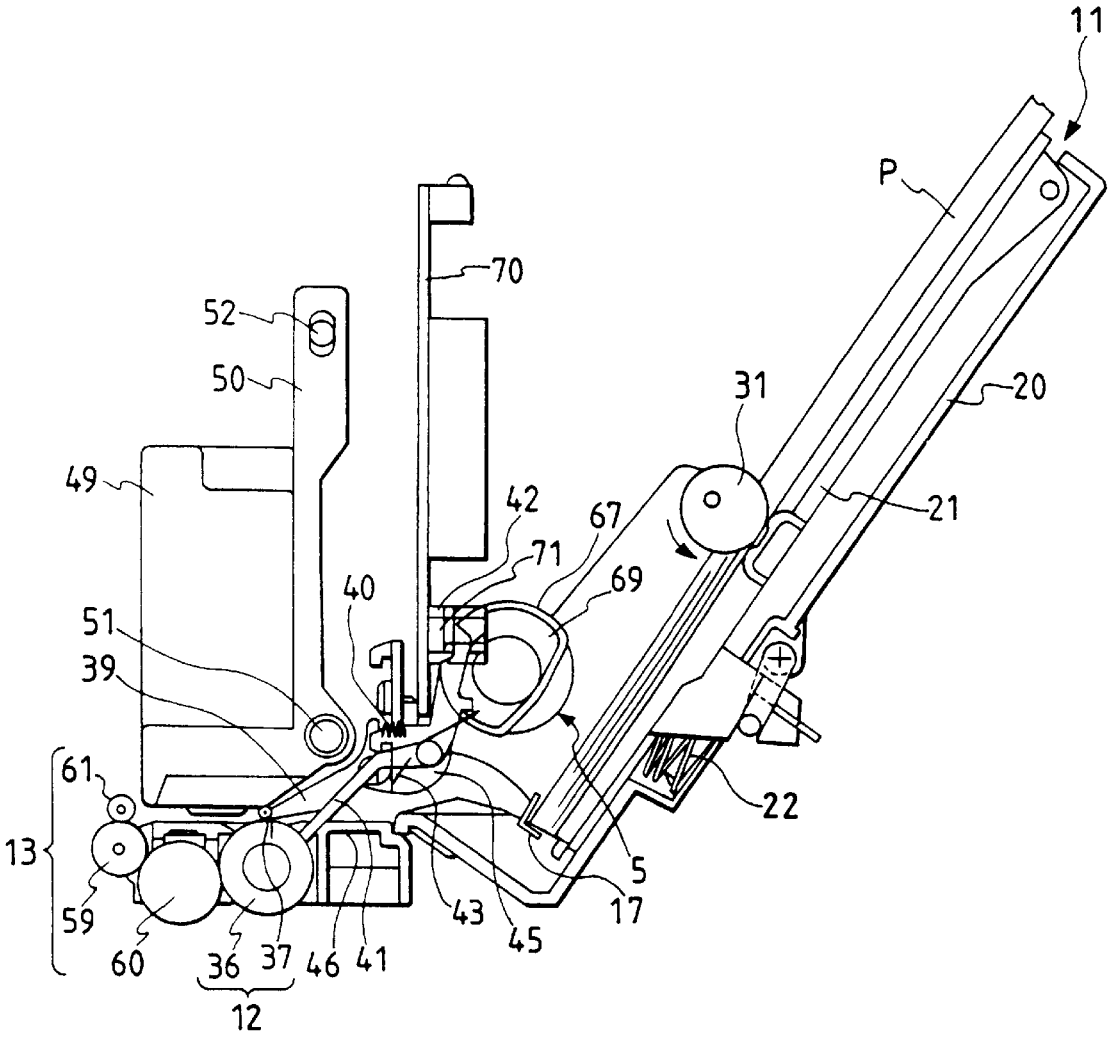
FIG. 2 is a schematic longitudinal crosssectional view of the ink jet recording apparatus as shown in FIG. 1.

The present invention will be now described by way of example with reference to the drawings, wherein like symbols refer to like or corresponding parts throughout the drawings. FIG. 1 is a typical perspective view showing one example of an ink jet recording apparatus to which the present invention is applied, and FIG. 2 is a longitudinal cross-sectional view of FIG. 1. The recording apparatus of the invention is an automatic feeder integral type, comprising a paper supply portion, a paper feeding portion, a paper exhausting portion, a carriage portion, and a recovery mechanism. First, each of these will be described in connection with the schematic constitution and the action.

In FIGS. 1 and 2, the paper supply portion 11 (automatic feeder) is attached at an angle from 30 to 60 degrees relative to a main body 3 of apparatus, wherein in this example, a recording sheet P set on the paper supply portion 11 is supplied to a recording portion, and after recording, the recording sheet P is exhausted horizontally. The paper supply portion 11 is comprised of a paper supply roller 5, a separation claw 17, a movable side guide 19, a base 20, a pressure plate 21, a pressure plate spring 22, a release cam 31, and an operation lever 33. And the paper supply portion 11 is activated by a driving power transmitted via a gear train from a drive source of a recording sheet conveying system provided on the main body side of the apparatus.

In the paper supply portion 11, when the release cam 31 is in a position of forcing the pressure plate 21 upward as shown in FIG. 2, the recording sheet P is placed in a state where it is spaced away from the paper supply roller 5, and not supplied. In the state with the recording sheet P set, if a drive force is transmitted via the gears to the paper supply roller 5 and the release cam 31, the release cam 31 first leaves from the pressure plate 21 to cause the pressure plate 21 to rise, so that the recording sheet P is forced against the paper supply roller 5, causing the recording sheet P at the uppermost layer to be picked up with the rotation of the paper supply roller 5, and separated one by one by the separation claw 17.

The separated recording sheet P is delivered to the paper feeding portion 12 provided on the main body of apparatus. Because the paper supply roller 5 and the release cam 31 are rotated once by the time when the recording sheet P is delivered to the paper feeding portion 12, the pressure plate 21 is restored to a release state where it is separated away from the paper supply roller 5, wherein the driving from the paper supply roller 5 to the recording sheet P is disconnected, and the initial state is retained.

The paper feeding portion 12 is comprised of a conveying roller 36, a pinch roller 37, a pinch roller guide 39, a pinch roller spring 40, a PR (pinch roller) sensor lever 41, a PE (paper end) sensor 42, a PE sensor spring 43, an upper guide 45, and a platen 46. The recording sheet P delivered to the paper feeding portion 12 is guided by the platen 46, the pinch roller guide 39 and the upper guide 45 for the delivery into a region (nip portion) between the conveying roller 36 and the pinch roller 37. The PE sensor lever 41 is provided in font of a pair of rollers consisting of the conveying roller 36 and the pinch roller 37, the recording position on the recording sheet P can be obtained by sensing the leading end of the recording sheet P.

By urging the pinch roller guide 39 with the pinch roller spring 40, the pinch roller 37 is forced against the conveying roller 36 to give rise to a conveying force for the recording sheet P. The recording sheet P fed by the pair of rollers 36, 37 is advanced along the platen 46 by controlling the rotation of the pair of rollers 36, 37 with the LF (line feed) motor 47. And the recording is performed on the recording sheet P which is guided along the platen 46 by driving the recording head 49 based on image information.

The recording head 49 (recording means) as shown is a replaceable ink jet cartridge having an ink tank integrated. The recording head 49 (recording means) is ink jet recording means for discharging the ink by the use of heat energy, and provided with electricity-heat converters for generating the heat energy. Also, the recording head 49 performs the recording by discharging the ink through the discharge ports by the use of pressure changes caused by growth and shrinkage of bubbles produced by film boiling owing to heat energy applied by the electricity-heat converters.

A carriage portion 15 is comprised of a carriage 50 for mounting the recording head 49 thereon, a guide shaft 51 for reciprocating the carriage 50 in the directions at right angles to a feeding direction of the recording sheet P, a guide 52 for holding the trailing portion of the carriage 50 to maintain the paper distance (spacing between the discharge port face 91 and the recording sheet P), a timing belt 55 for transmitting the driving of a carriage motor 53 to the carriage 50, an idle pulley 56 for stretching the timing belt 55, and a flexible cable 57 for passing a head drive signal from a control circuit to the recording head 49. When the recording head 49 is moved (scanned) integrally with the carriage 50, the image is recorded on the recording sheet P conveyed on a platen 46.

The paper exhausting portion 13 is comprised of a paper exhausting roller 59, a transmission roller 60 for transmitting a drive force of the conveying roller 36 to the paper exhausting roller 59, and a spur 61 for applying an exhausting force to the recording sheet P. By employing a paper exhausting roller pair consisting of the paper exhausting roller 59 and the spur 61, the recording sheet P is exhausted onto a paper exhausting tray 62 without contaminating the image formed on the recording face thereof.

Figure 3:
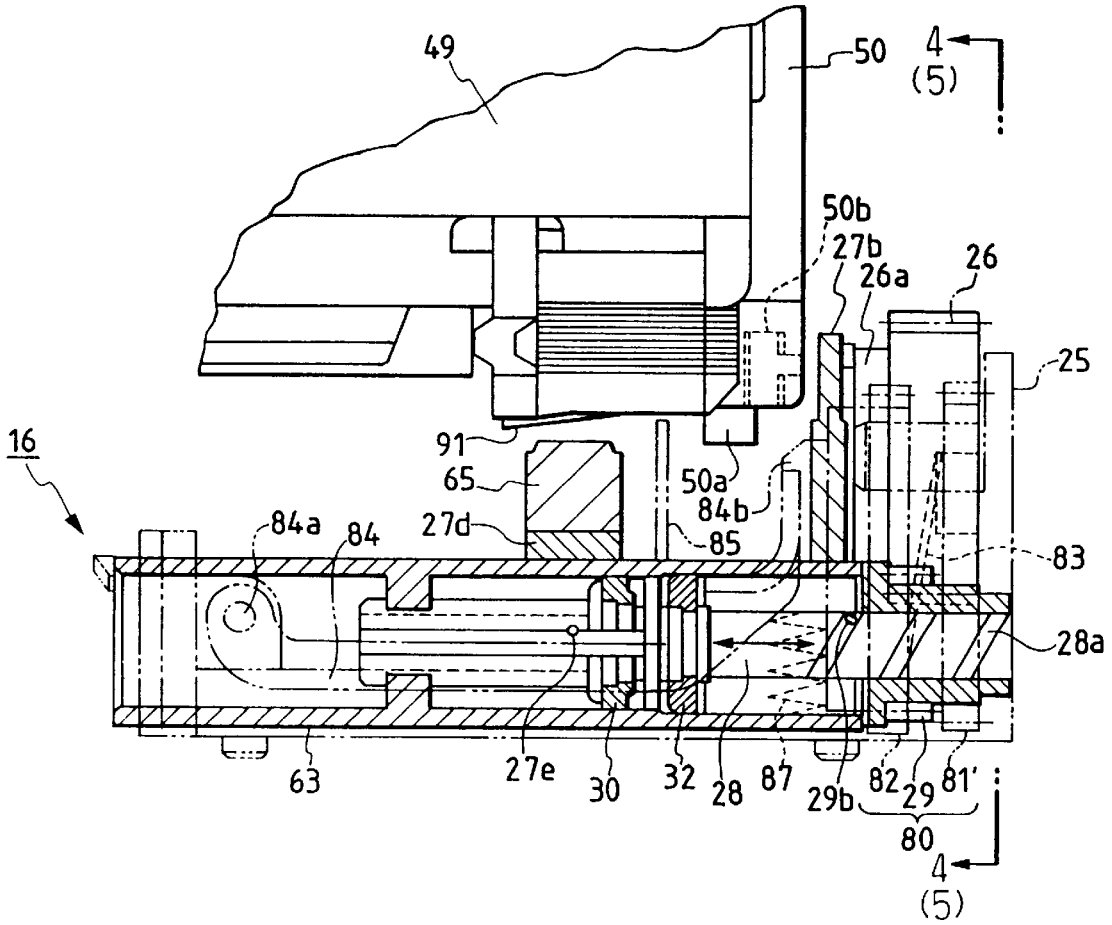
FIG. 3 is a schematic front view typically showing a recovery device according to a first example of the ink jet recording apparatus to which the present invention is applied.
Figure 4:
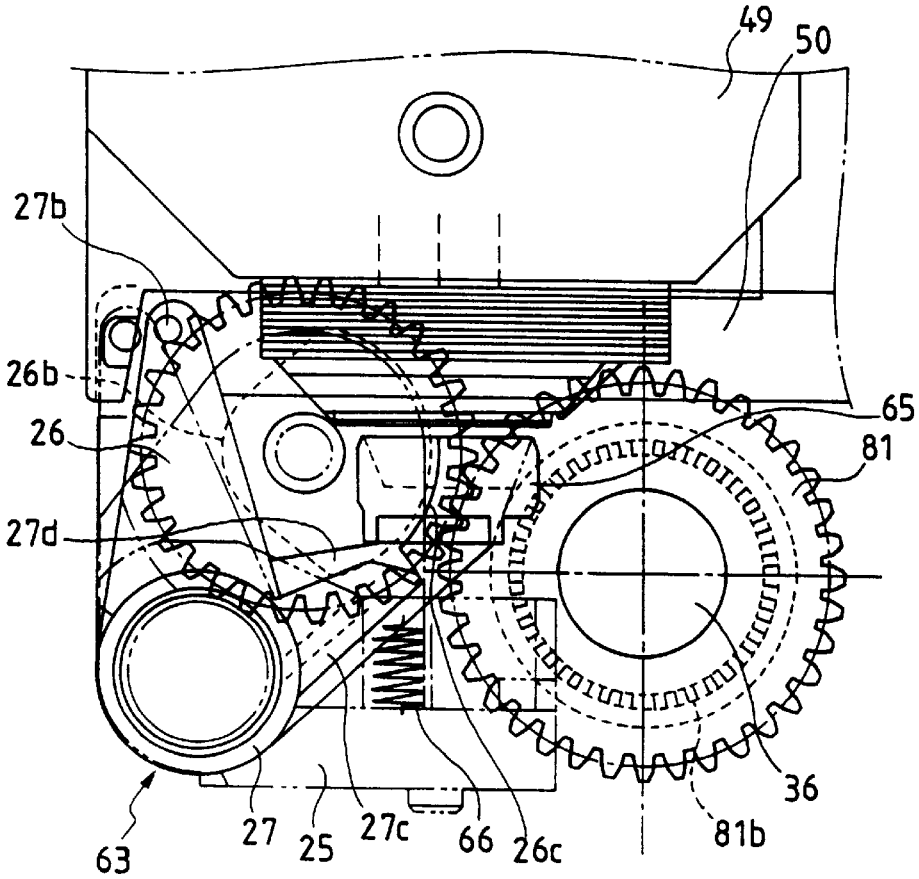
FIG. 4 is a cross-sectional view mainly showing a cap member and gears as viewed from the line 4—4 in FIG. 3.
Figure 5:
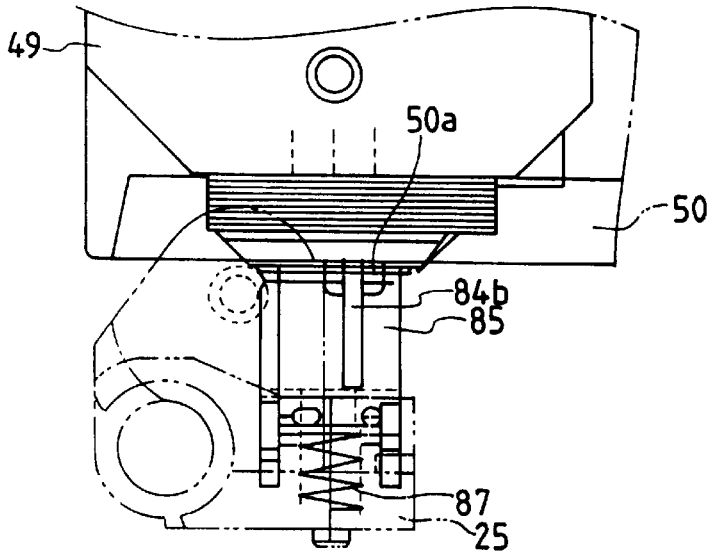
FIG. 5 is a cross-sectional view mainly showing a wiper as viewed from the line 5—5 in FIG. 3.

FIG. 3 is a partial front view showing partially a first example of a recovery device to which the present invention is applied. Also, FIG. 4 is a cross-sectional view of a capping portion 65 taken along the line 4—4 in FIG. 3. FIG. 5 is a cross-sectional view of a wiper 85 taken along the line 5—5 in FIG. 3.

Figure 14:
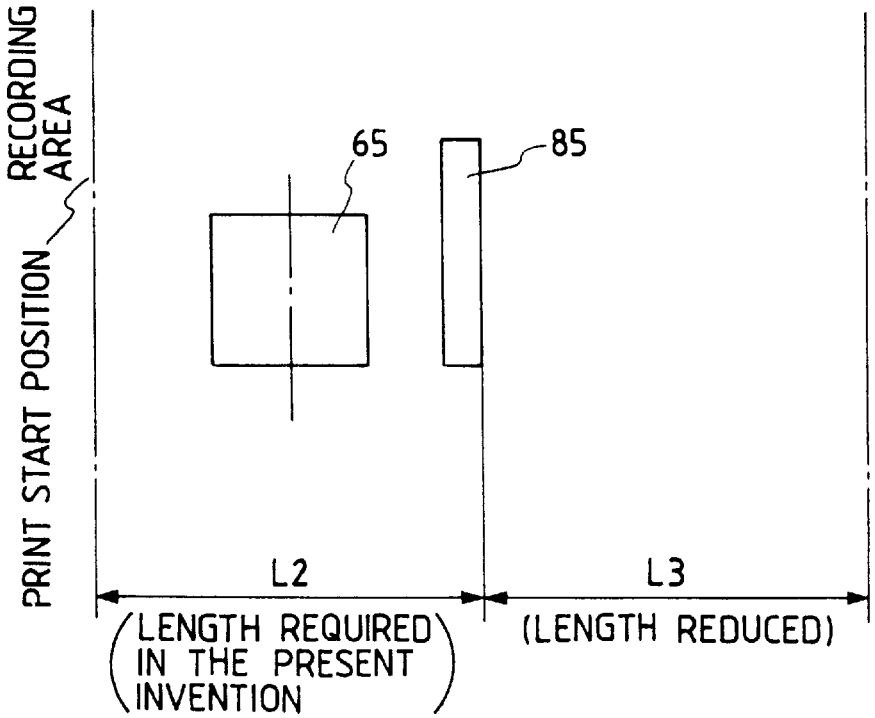
FIG. 14 is a schematic diagram showing the arrangement of a recovery device to which the present invention is applied.

An arrangement and configuration for the recovery device 16 as shown in FIG. 3 to which the present invention is applied is shown in FIG. 14.

As shown in FIG. 14, a cap 65 is disposed facing the recording start position (recording area) and in front of the wiper 85. The area where this cap is disposed is one corresponding to a space for preventing the dispersion of the ink yielded by the wiper 85 when cleaning the recording head over the recording area. Because of the provision of the area for the cap 65, firstly, a space conventionally required to provide the cap can be eliminated, and a space as indicated by L2 is only needed. Namely, in FIG. 14, the amount of space indicated by L3 can contribute to the reduction in size of the apparatus.

Secondly, because the cap does not pass the wiper to transfer to a capping state after recording, means for extending or retracting the wiper such as a latch mechanism can be dispensed with, resulting in the simpler construction.

Thirdly, in the state where the wiping has been performed, there is the wiped ink that has entered the discharge ports of the recording head, or in the color head, there may occur a state of color mixing, whereby it is preferable to perform a predischarge to remove such ink. In the constitution of the present invention, the wiper is necessarily forced to pass the cap after wiping, whereby the predischarge is allowed into the cap. Also, since the ink discharged by performing the predischarge can be expelled outside by a pump connecting to the cap, the waste ink can be securely processed.

Fourthly, it was conventionally obliged to secure a predetermined space between the wiper and the cap because of the structure of retractable wiper or cap, but any complex structure is unnecessary, and the spacing between the wiper and the cap can be shortened, which further contributes to the reduction in size of the apparatus.

Fifthly, as will be described below, when the wiper cleans the recording head, the contact state between the wiper and the recording head can be released with an extremely simple constitution at the end of cleaning and immediately before the wiper leaves away from the recording head, to retract the wiper from the recording head, whereby the dispersion of the ink can be suppressed. Also, even if the ink disperses and the dispersed ink sticks to the cap, the ink can be efficiently withdrawn as the waste ink by a pump.

Sixthly, in the ink jet recording apparatus, a predischarge (idle discharge) is performed during the recording to maintain the discharge condition excellent, but even in this case, the cap is disposed irrespective of the wiper (i.e., the cap does not pass the wiper area upon the predischarge during the recording as conventionally, in which it is unnecessary to perform the extension or retraction of wiper, and the number of wipings with the wiper having no extension or retraction operation can be reduced), and the discharge port face is less subject to damage.

The constitution of the recovery device will be described below. In FIGS. 1 to 5, the cleaning portion 16 is comprised of a pump 63 and a wiper for cleaning the recording head 49, a cap 65 for preventing the discharge ports 92 of the recording head 49 from drying, and drive transmission means 80 for switching and transmitting a driving force from the conveying roller 36. When the cleaning operation is not performed, the driving force of the conveying roller 36 is not transmitted to the cleaning portion 16. However, the driving force can be transmitted by moving the carriage 50 and triggering a pump gear 26 having a defective tooth portion by means of a trigger gear 82.

The cap 65 is caused to rise or fall (press onto or separate from the discharge port face 91) by a cam 26*b* provided on the pump cam gear 26. The rising or falling of the cap 65 can be performed in accordance with a control sequence of the capping operation or suction recovery operation. Also, the wiper 85 is held within a wiper holder 84, which is rotatably supported around one point as a fulcrum 84*a*, And the wiper 85 can be advanced to or retracted from the discharge port face 91 by bringing a part 84*b* of the wiper holder 84 into contact with the recording head 49, or with an abutment member 50*a* provided on the carriage 50 or the recording head 49.

An LF motor 47 for driving the conveying roller 36 and a carriage motor 53 for driving the carriage 50 are a stepping motor which rotates by a predetermined degrees in accordance with a signal sent from a driver, not shown. The paper supply roller 5 is provided with a sensor plate 69 having a smaller radius than the radius of a paper supply roller rubber 67 attached to the paper supply roller 5. As shown in FIG. 2, the sensor plate 69 is cut out in part, whereby a roller sensor 71 consisting of a photo-interrupter provided directly on an electrical substrate 70 is transparent to the light, without interrupting the light, only when the paper supply roller 5 and the release cam 31 are in the initial position of releasing the pressure plate 21 as shown in FIG. 2.

By sensing the state of the sensor plate 69, the angular position of the paper supply roller 5 and the angular position of the release cam 31 rotated in phase with the paper supply roller can be detected, and based on the detected value, the control timing in the sequence of supplying the recording sheet P can be determined.

Next, the detailed structure and operation of the cleaning portion 16 as previously described will be described below. In FIG. 4, the LF gear 81 is secured to the conveying roller 36 under the pressure and rotated together with the conveying roller 36. The trigger gear 82 is attached along the peripheral surface of the conveying roller 36 to be movable to left and right in FIG. 3. Normally, the trigger gear 82 is out of touch with the LF gear 81 by means of a trigger spring 83, so that the driving force of the conveying roller 36 is transmitted to the trigger gear 82.

If the carriage 50 is moved to the right end in FIG. 3 to cause its pressing portion 50*a* to force the trigger gear 82 to be moved to the LF gear 81, angular teeth provided on the LF gear 81 and the trigger gear 82 mesh, so that the driving force of the LF gear 81 is transmitted to the trigger gear 82. Herein, the LF gear 81 and the trigger gear 82 are configured to be in phase with each other.

The pump cam gear 26 always meshes with the trigger gear 82, but adjoins the LF gear 81 on a part of the defective tooth portion 26*c*, and normally does not mesh with the LF gear 81. Accordingly, the driving force of the conveying roller 36 is normally not transmitted to the pump cam gear 26. However, as previously described, if the trigger gear 82 and the LF gear come into contact with each other, the LF gear 81 will mesh with the pump cam gear 26, so that the driving force of the conveying roller 36 is transmitted to the pump cam gear 26.

The recovery mechanism 16 is a unit having the components incorporated onto a pump base 25, and is provided with a pump 63 for sucking the ink from the recording head 49. The pump 63 is comprised of a cylinder 27, a piston 30, a piston shaft 28, a stroke gear 29, and a cap 65. The piston shaft 28 has a lead screw 28*a* formed therearound, with which the rotation of pump gear 26 can be transmitted to the stroke gear 29, and by a pin 29*b* engaging the lead screw 28*a* of the piston shaft 28 provided on the stroke gear 29, the rotation of the stroke gear 29 is transformed into the rectilinear motion of the piston shaft 28.

The piston shaft 28 has a pump seal 32 and a piston mounted, and by moving the piston shaft 28, a negative pressure is produced within the piston 30, this negative pressure being passed via a suction opening 27*e* of the cylinder 27 to the inside of the cap 65. Accordingly, if the piston shaft 28 is moved with the discharge ports of the recording head 49 capped (sealed) with the cap 65, the ink is sucked (aspirated) through the discharge ports 92 owing to the negative pressure passed to the inside of the cap 65, so that the ink flows into the cylinder 27.

The cap 65 is made of butyl rubber chloride having a hardness of 20 to 50 degrees, for example, and directly attached to a cap arm 27*d* of the cylinder 27. The cylinder 27 is formed rotatably around its inner diameter, and makes the capping by pressing the cap 65 against the discharge port face 91 of the recording head 49 under the bias of a cap spring 66, as much as a force of 50 to 150 g, to prevent any negative pressure from leaking out of the cap 65 upon capping.

A rotational arm 27*c* of the cylinder 27 comes into contact with a cam 26*b* provided on the pump cam gear 26 to set the angular position of the cylinder 27. Accordingly, the capping can be effected or released at a predetermined position, depending on the angular position of the pump cam gear 26. Further, the cylinder 27 is provided with a carriage lock arm 27*b*, wherein when the recording head 49 comes to a capping position, the carriage lock arm 27*b* is engaged into a fitting portion 50*b* of the carriage 50 to enable the positioning and fixing of the carriage 50.

At this time, even if the carriage 50 is more or less offset from the capping position, the carriage lock arm 27*b* acts on a taper face of the fitting portion 50*b*, thereby correcting for the carriage position. Also, because of the constitution of bearing the carriage 50 therebetween, the recording head 49 can be positioned at a fixed site owing to a pressing force from the cap spring 66, even if the recording head 49 escapes away, so that the capping can be effected correctly with a predetermined contact force.

The wiper 85 is made of urethane rubber having a hardness of about 15 to 50 degrees, or formed of a plate member having a thickness of 0.5 mm to 1.0 mm, such as HNBR, and attached to a wiper holder 84 by a wiper presser 86. The wiper holder 84 is rotatably disposed with its one end supported by the pump base 25. Upon the presser portion 50*a* of the carriage 50 coming into contact with a positioning portion 84*b* of the wiper holder 84, the amount of admitting the wiper 85 into the discharge port face 91 of the recording head 49 can be regulated, and the contact or separation of the wiper with or from the discharge port face 91 can be controlled.

Figure 6A:
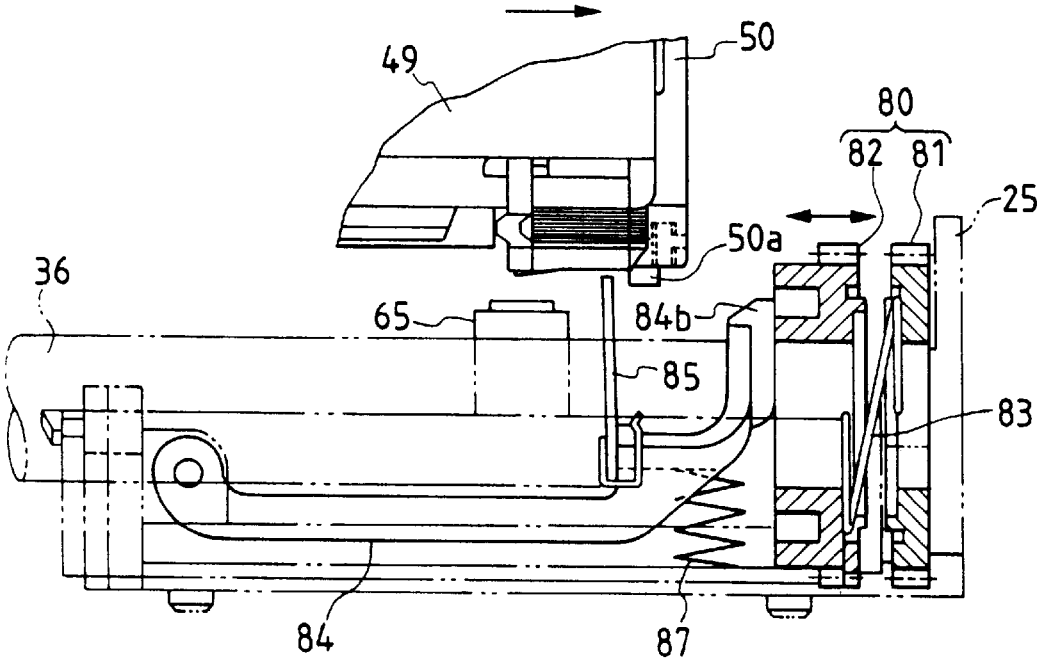
FIGS. 6A to 6D are partial front views showing in sequence the states where recording means is moving for wiping in the first example of the present invention.
Figure 6B:
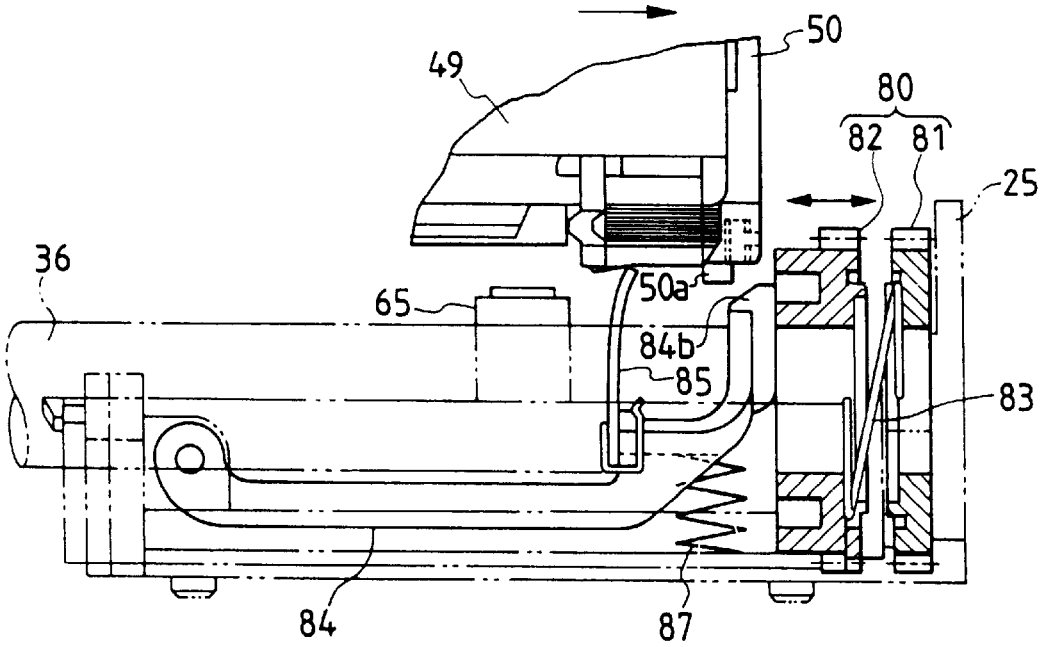
Figure 7:
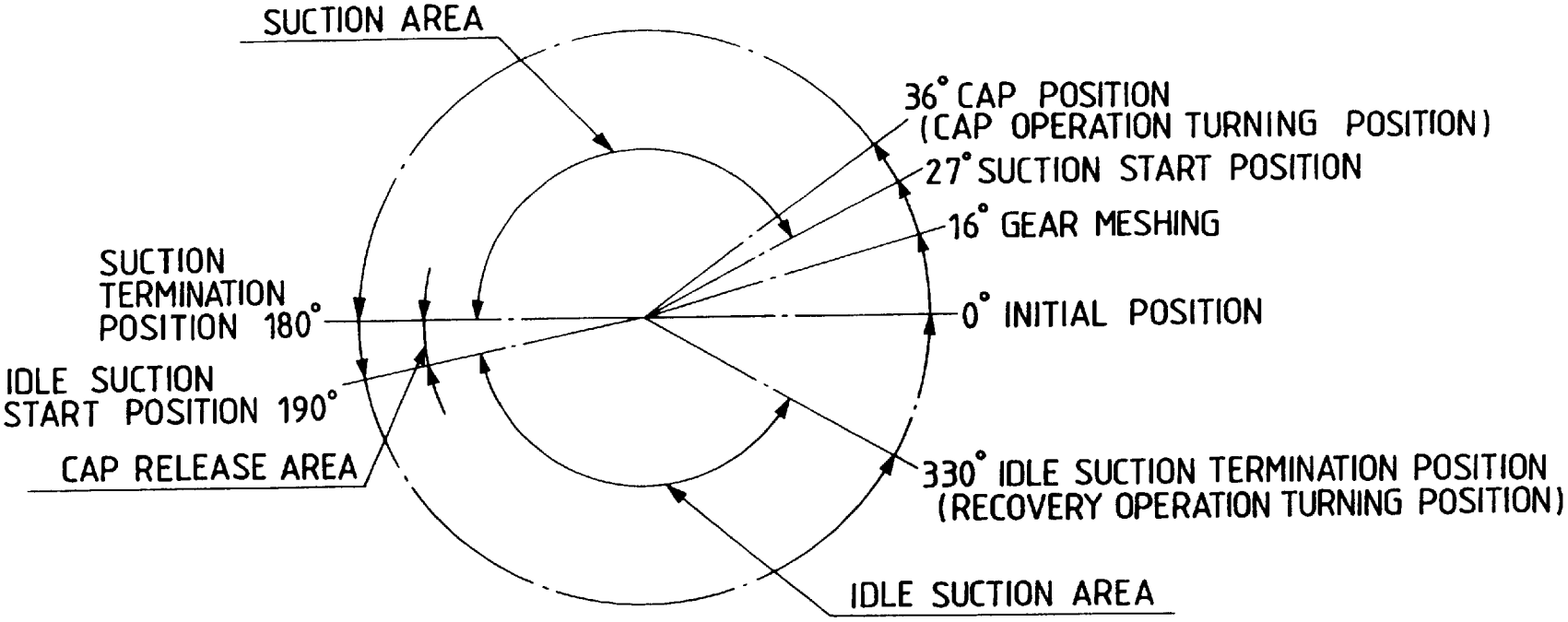
FIG. 7 is an explanatory view for showing the relation between the actuation and the angular position of a pump cam gear in the first example of the invention.
Figure 8:
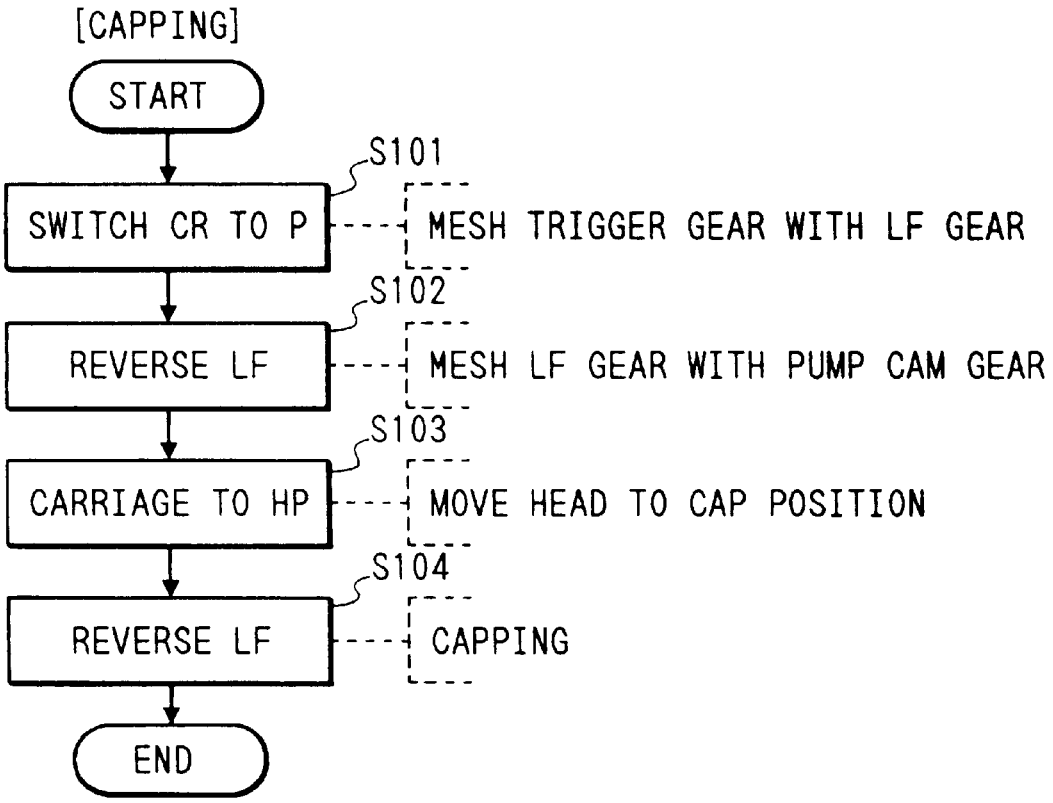
FIG. 8 is a flowchart of the capping operation.
Figure 9:
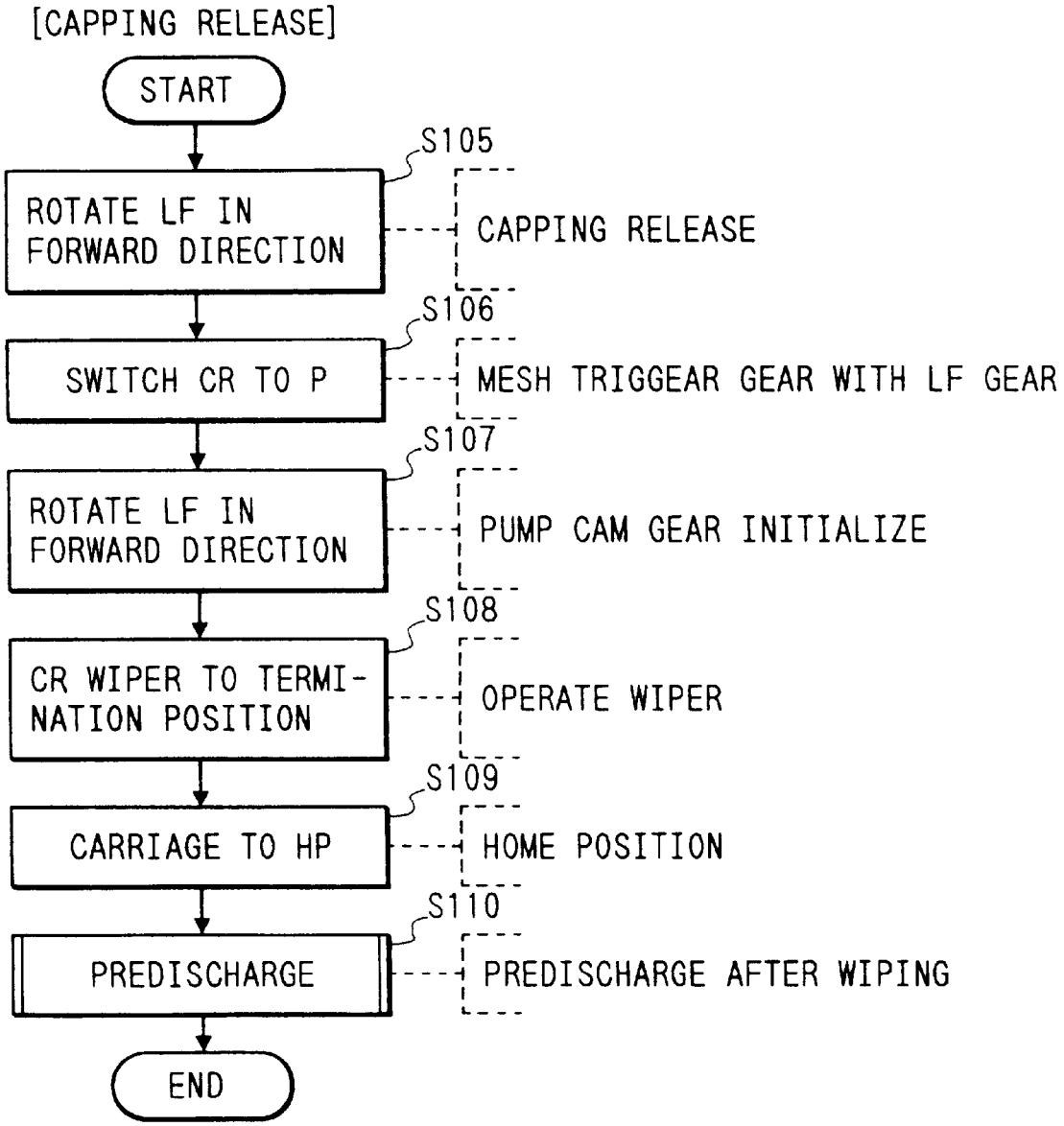
FIG. 9 is a flowchart of the capping release operation.
Figure 10:
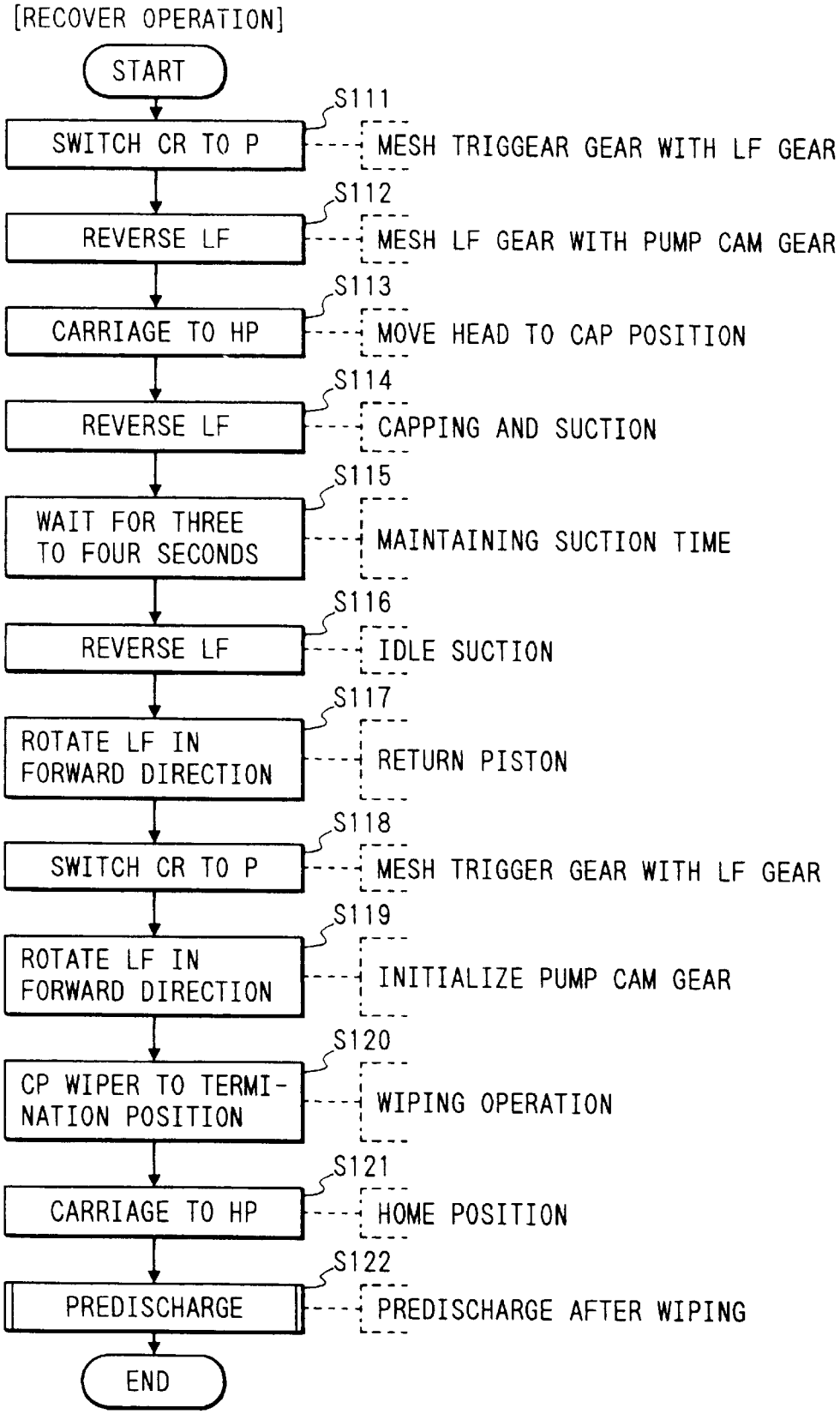
FIG. 10 is a flowchart of the suction recovery operation.

Next, the recovery mechanism 16 according to the first example of the present invention will be described with the action and control of the cleaning. FIGS. 6A to 6D are explanatory operation views showing he activation of wiping means 85 onto the recording head 49, FIG. 7 is an explanatory operation view showing the activation at each angular position of the pump cam gear 26, and FIGS. 8 to 10 are flowcharts showing the operation sequences, including capping, release and recovery operation.

First, the wiping operation of wiping out the discharge port face 91 of the recording head 49 will be described below with reference to FIGS. 6A to 6D. In this case, the recording head 49 is moved to or from the wiper 85 in the sequence from FIGS. 6A to 6D. Firstly, the recording head 49 comes closer to the wiper 85 with an admission amount of about 0.6 to 1.0 mm, as shown in FIG. 6A, and caused to pass the wiper which is bent while sliding on the discharge port face 91 of the recording head 49, as shown in FIG. 6B.

Figure 6C:
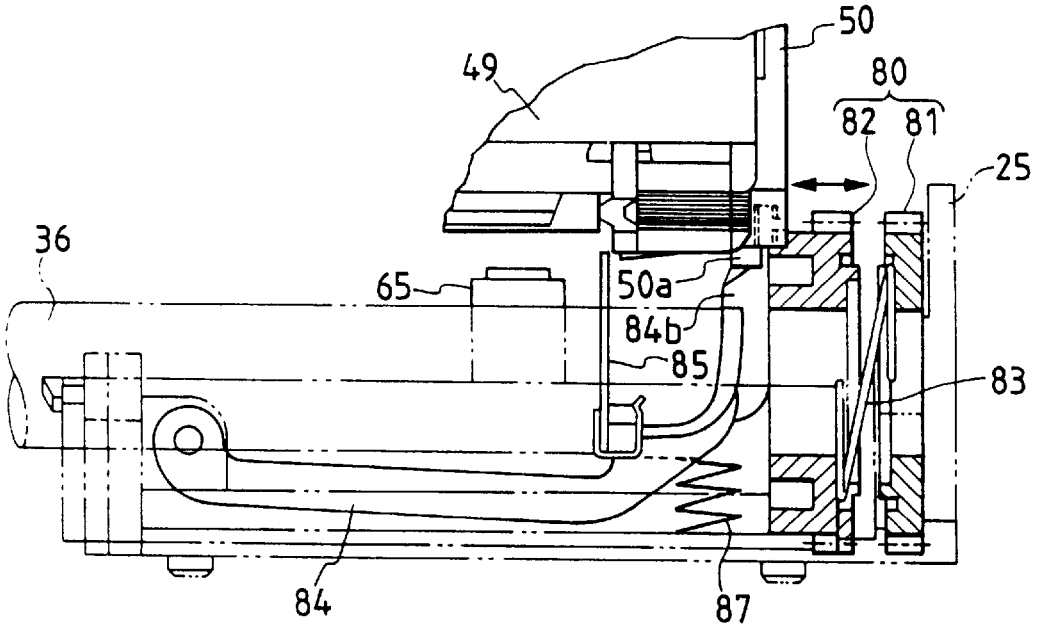
Figure 6D:
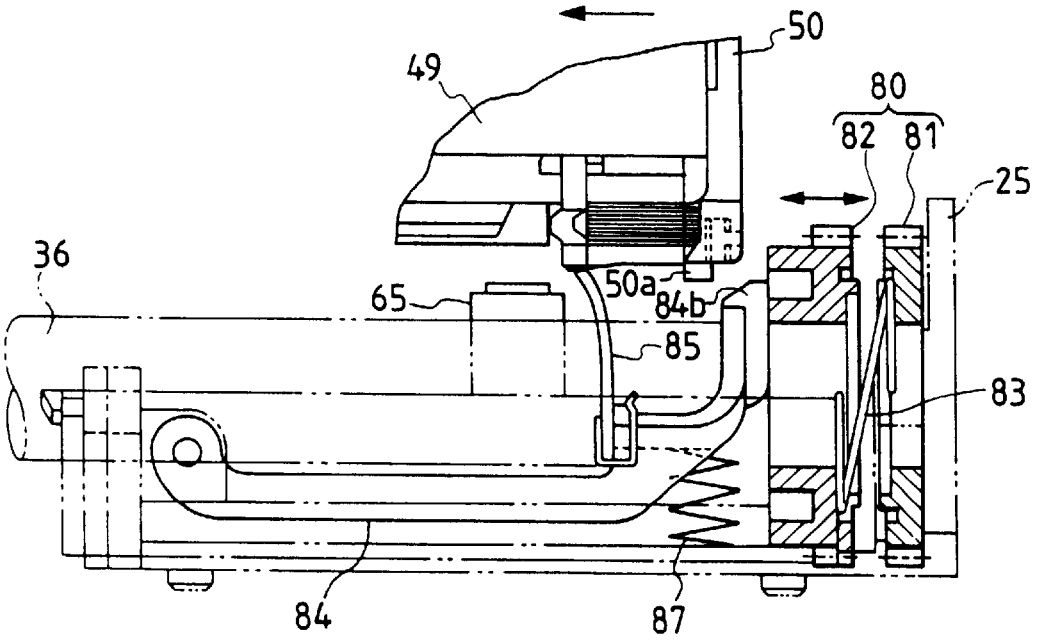

When the recording head 49 comes to a position as shown in FIG. 6C, the carriage 50 will act on the positioning portion 84*b* of the wiper holder 84, thereby causing the wiper 85 to fall down (separate). With this operation, the bent wiper 85 is freed, so that the wiper is once separated from the recording head 49. At this position the moving direction of recording head 49 is reversed, so that the recording head 49 will approach to the wiper 85 from the opposite direction, as shown in FIG. 6D. At this time, the positioning of the wiper holder 84 with respect to the carriage 50 is released, so that the wiper 85 moves (rises) to a position capable of wiping the recording head 49. And by causing the wiper 85 to be bent again and pass the discharge port face 91 of the recording head 49, the cleaning (wiping) of the discharge port face 91 is performed.

Next, the operations will be described in connection with the angular position of the pump cam gear 26. First, the capping operation of enclosing the discharge orifice face 91 to prevent the ink from drying and the foreign matter from entering the discharge ports 92 during the recording will be described below with reference to a flowchart of FIG. 8. In FIG. 8, at step S101, the carriage 50 is moved to mesh the trigger gear 82 with the LF gear 81, thereby to be ready for the transmission of a driving force of the conveying roller 36 to the pump cam gear 26.

At step S102, the conveying roller 36 is rotated reversely to mesh the pump cam gear 26 with the LF gear 81, thereby causing the pump cam gear 26 to be rotated about 16 degrees, as shown in FIG. 7. At step S103, the carriage 50 is moved to a home position HP which is a capping position. At this time, the trigger gear 82 is separated from the LF gear 81 under the action of the trigger spring 83, but because the pump am gear 26 and the LF gear 81 are meshed, the transmission of the driving force of the conveying roller 36 to the pump cam gear 26 is never interrupted.

At step S104, if the conveying roller 36 is further rotated, the cam 26*b* of the pump cam gear 26 will act on a rotational arm 27*c* of the cylinder 27 to cause the cylinder 27 to be rotated, so that the cap 65 is brought into contact with the discharge port face 91 of the recording head 49 to effect the capping state. Further, the carriage lock arm 27*b* of the cylinder 27 will act on the carriage 50 to perform the correct positioning and fixing of the carriage 50.

If there is a command for recording, the capping is released, and the recording is enabled. Then, the capping release operation will be described below with the reference to the flowchart of FIG. 9. In FIG. 9, at step S105, the conveying roller 365 is rotated forwardly to effect the capping release and the fixing release of the carriage 50. At step S106, the carriage 50 is moved again to force the trigger gear 82 to mesh with the LF gear 81. At step S107, the conveying roller 36 is further rotated forwardly to return the pump cam gear 26 to the initial position. And at step S108, the wiping operation of FIGS. 6A to 6D is performed, and at step S109, the carriage 50 is moved to the home position, where the predischarge of the ink into the cap 65, that is, the predischarge after the wiping operation, is performed at this home position (step S110).

If the ink dries or fixes near the discharge orifices 92, or the foreign matter such as bubbles or dust enters the ink within the discharge ports 92, an ink discharge failure will occur, or may occur with high possibility. As the cleaning operation for recovering or maintaining the normal ink discharge by removing any cause of such discharge failure, a suction recovery operation of sucking the ink through the discharge ports 92 by means of a pump can be performed. Next, this suction recovery operation will be described below with reference to the flowchart of FIG. 10.

The suction recovery operation is performed in accordance with an operation procedure as indicated by steps S111 to S122 as shown in FIG. 10. Steps S111 to S113 of FIG. 10 are identical to the steps S101 to S103 during the capping operation as shown in FIG. 8 and previously described. In FIG. 10, at step S114, the conveying roller 36 is further rotated reversely to cause the piston 30 to be further moved, thereby effecting the ink suction.

At step S115, a time lag for the ink suction is absorbed to attain a predetermined amount of suction. At step S116, the conveying roller 36 is further rotated reversely to cause the cap 65 to be separated from the recording head 49 to open the discharge ports 92 to the atmosphere, thereby effecting the idle suction operation for sucking the ink within the cap 65 into the cylinder 27. And when the pump cam gear 26 comes to a position about 330 degrees apart from the initial position, the rotation of the conveying roller 36 is switched to the forward direction to return the pump cam gear 26 to a position 16 degrees apart from the initial position. And the latter half of the recovery operation from step S118 to step S122 is exactly the same as the operation from step S106 to step S110 for the capping release as shown in FIG. 9 and previously described.

According to the example as above described, the following effects can be obtained. Firstly, since the wiping member 85 is disposed outside the cap 65, means for extending or retracting (projecting or retreating) the wiping member such as a latch mechanism can be omitted, so that the factor of noise can be reduced. Secondly, the number of times that the recording head 49 enters the wiping member 85 can be reduced, and correspondingly, the wiping member 85 and the recording head 49 can be improved in durability and less subject to damage.

Thirdly, in operating the wiping member 85 upon the recording head 49 in the reciprocating (bidirectional) movement, the wiping member 85 can be retracted upon reversing the carriage 50 to reverse the direction of the wiping member acting on the recording head 49, so that the travel distance of the carriage 50 can be shortened, and the recording apparatus reduced in size. Fourthly, since the cap 65 is caused to contact or separate (rise or fall) by using a driving force of the conveying roller 36, the capacity of carriage motor 53 can be optimized, resulting in more efficient design. Fifthly, the simpler overall constitution can be made, resulting in the reduced number of parts, the reduced cost, the smaller and lighter apparatus, and the improved reliability of apparatus.

Figure 11:
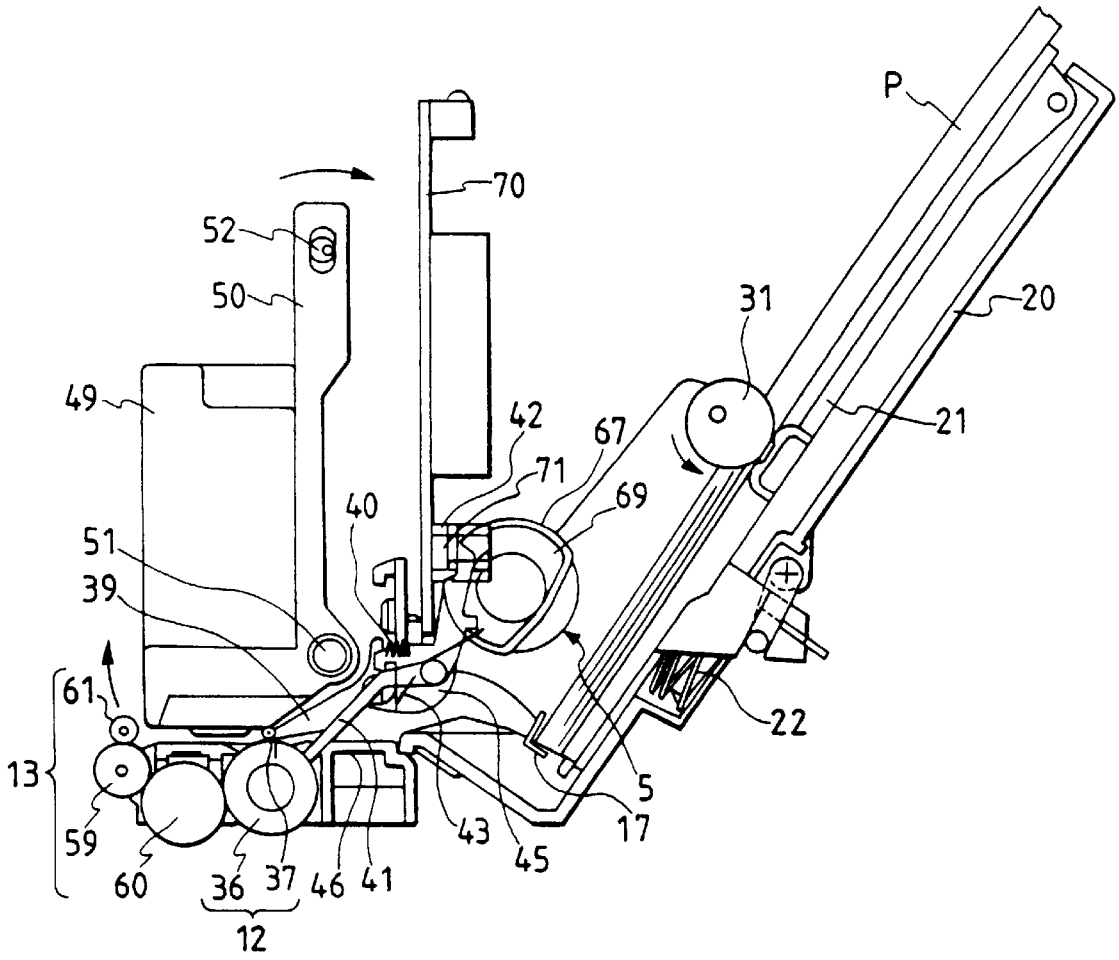
FIG. 11 is a longitudinal cross-sectional view schematically showing a second example of an ink jet recording apparatus to which the present invention is applied.

FIG. 11 is a longitudinal cross-sectional view typically showing the constitution of a second example of an ink jet recording apparatus to which the present invention is applied. While in the previous example, in wiping in the reciprocal (bidirectional) directions, the wiper 85 is once separated from the recording head 49 upon reversing the carriage 50 in the movement direction, and the wiper (wiping means) 85 is retracted from the recording head 49 to reverse the contacting direction, it should be noted that the recording head 49 is retracted from the wiping means 85 in this example.

That is, the second example is configured such that, by making an eccentric cross-sectional shape of the guide 52 on the right end portion, the carriage 50 is urged to the direction leaving away from the wiping means 85 within a fixed range including a position example, and is not described in detail any more. The second or third example as above described can also attain the same actions and effects as in the first example.

While in the previous examples one recording means was mounted on carriage means, it should be understood that the present invention is similarly applicable to a plurality of recording means mounted on the carriage to make the color recording which employs a plurality of recording means for recording in different colors, or the gradation recording which employs a plurality of recording means for recording in the same color and different densities, or the recording which employs the combination thereof, thereby bringing abut equivalent effects.

Furthermore, the present invention is also applicable to whatever arrangement or constitution for the recording head and the ink tank, such as the recording head and the ink tank integrally formed as a replaceable head cartridge, or the recording head and the ink tank separately provided and connected via a tube for the supply of ink, thereby bringing about equivalent effects.

The present invention is applicable to any ink jet recording apparatus, for example, recording means (recording head) using the electromechanical converter such as a piezoelectric element, but can bring about where the carriage 50 reverses the travel direction. With such a constitution, the wiping means (wiper) 85 may remain fixed, so that the constitution of the wiping means can be simplified. Note that the other constitution of the second example is substantially the same as that of the first example, wherein the corresponding parts are designated by like numerals, and it is not described in detail any more.

Figure 12:
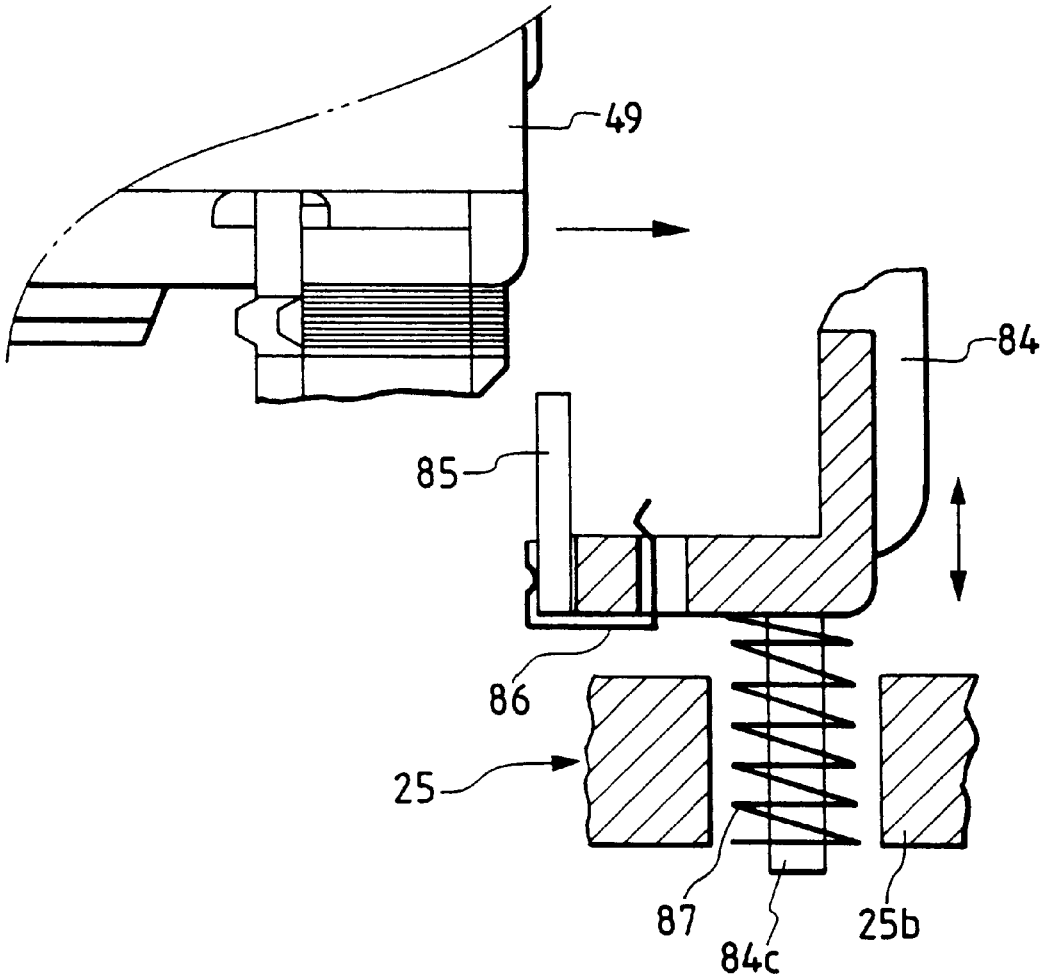
FIG. 12 is a partial front view schematically showing a wiping mechanism according to a third example of the present invention.
Figure 13:
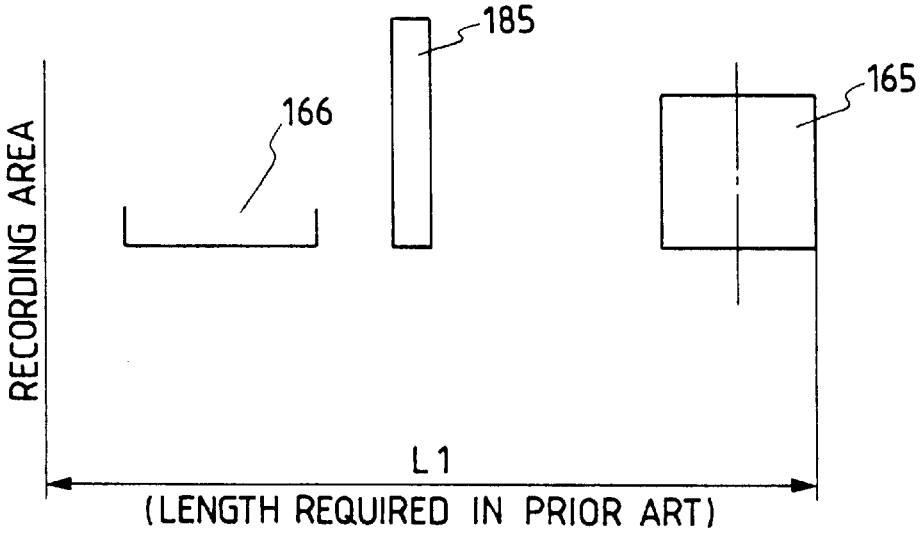
FIG. 13 PRIOR ART
FIG. 13 is a schematic diagram showing a configurational example of the conventional recovery device arrangement.

FIG. 12 is a partial front view typically showing the constitution and operation of a wiping mechanism in a third example of an ink jet recording apparatus to which the present invention is applied. While in the first example, the wiping holder 84 is attached to the pump base 25 rotatably around one end as a fulcrum, it will be appreciated that the wiping holder 84 may be moved in linear motion. In FIG. 12, a guide portion 25*b* is provided on the pump base 25, a wiper spring 87 is attached to the supporting shaft 84*c* provided on the wiper holder 84, and the wiper holder 84 is attached with the wiper spring 87 and the supporting shaft 84*c* extending through the guide portion 25*b*.

With the constitution as shown in FIG. 12, the required space can be reduced without having to lengthen the rotational arm of the wiper holder 84. The other portion in the third example as shown in FIG. 12 is substantially the same as that of the first excellent effects especially in an ink jet recording apparatus using recording means of the type of discharging the ink by the use of heat energy. The use of such a system allows the recording with higher density and higher resolution.

What is claimed is:

1. A recovery device for making recovery of recording means mounted on carriage means which can reciprocate, said recovery device comprising capping means for capping an ink discharge portion of said recording means when not in use, and wiping means for wiping out the ink discharge portion of said recording means with a movement of said carriage means, wherein said wiping means and said capping means are independently operable, and wherein said wiping means is disposed at an area outside said capping means relative to the recording area, said wiping means is supported by supporting means, the supporting means being adjusted to abut to a carriage for mounting said recording means, and a portion of said carriage and said supporting means are abutted to each other to retract and separate said wiping means from said ink discharge portion of said recording means immediately before said wiping means completes a cleaning of said ink discharge portion, when said wiping means wipes the ink discharge portion of said recording means by a movement of said carriage from the recording area a to a non-recording area.

2. A recovery device according to claim 1, characterized in that said wiping means wipes out said recording means in reciprocal directions of the movement of said carriage means.

3. A recovery device according to claim 1, further comprising conveying means for conveying the recording sheet to a predetermined position, drive transmission means for transmitting a drive force of said conveying means, trigger means for cooperating with said drive transmission means to transmit the drive force of said conveying means as the drive force for said capping means with the movement of said carriage means, and cap elevating means for placing said capping means into or out of contact with recording means by the drive force transmitted by said drive transmission means, wherein said carriage means acts on said trigger means to cause said carriage to move to the capping position, and then to drive said cap elevating means for the capping.

4. A recovery device according to claim 3, further comprising suction means for sucking the ink through the discharge ports of recording means via capping means, wherein said suction means is activated by a drive force transmitted by said drive transmission means.

5. A recovery device according to claim 1, further comprising conveying means for conveying the recording sheet to a predetermined position, drive transmission means for transmitting a drive force of said conveying means, trigger means for cooperating with said drive transmission means to transmit the drive force of said conveying means as the drive force for said capping means with the movement of said carriage means, and cap elevating means for placing said capping means into or out of contact with recording means by the drive force transmitted by said drive transmission means, wherein said carriage means acts on said trigger means to cause said carriage to move to the capping position, and then to drive said cap elevating means for the capping.

6. A recovery device according to claim 5, further comprising suction means for sucking the ink through the discharge ports of recording means via capping means, wherein said suction means is activated by a drive force transmitted by said drive transmission means.

7. A recovery device according to claim 1, wherein said recording means performs recording by discharging ink using heat energy.

8. A recovery device for making recovery of recording means mounted on carriage means which can reciprocate, said recovery device comprising capping means for capping an ink discharge portion of said recording means when not in use, and wiping means for wiping out the ink discharge portion of recording means with a movement of said carriage means, wherein said wiping means and said capping means are independently operable, wherein said wiping means is disposed at an area outside said capping means relative to a recording area, said wiping means is supported by supporting means, the supporting means being adjusted to abut to a carriage for mounting said recording means, and a portion of said carriage and said supporting means are abutted to each other to retract and separate said wiping means from said ink discharge portion of said recording means immediately before said wiping means completes a cleaning of said ink discharge portion, when said wiping means wipes the ink discharge portion of said recording means by a movement of said carriage from the recording area to a non-recording area.

9. A recovery device according to claim 8, wherein said recording means performs recording by discharging ink using heat energy.

10. An operating method for an ink jet recording apparatus having a recording means with an ink discharge portion, a carriage means which can reciprocate, a capping means for capping the ink discharge portion of said recording means when not in use, and a wiping means for wiping out the ink discharge portion of said recording means with a movement of said carriage means, said wiping means and said capping means being independently operable, the method comprising the steps of:

wiping out, by said wiping means, the ink discharge portion of said recording means with a movement of said carriage; and performing a predischarge by said recording means into said capping means after wiping, wherein said wiping means is disposed at an area outside said capping means relative to a recording area, said wiping means is supported by supporting means, the supporting means being adjusted to abut to a carriage for mounting said recording means, and a portion of said carriage and said supporting means are abutted to each other to retract and separate said wiping means from said ink discharge portion of said recording means immediately before said wiping means completes a cleaning of said ink discharge portion, when said wiping means wipes the ink discharge portion of said recording means by a movement of said carriage from the recording area to a non-recording area.

11. An operating method for an ink jet recording apparatus according to claim 10, wherein said recording means performs recording by discharging ink using heat energy.

* * * * *

UNITED STATES PATENT AND TRADEMARK OFFICE

CERTIFICATE OF CORRECTION

PATENT NO. : 6,189,998 B1
DATED : February 20, 2001
INVENTOR(S) : Yanagi et al.

It is certified that error appears in the above-identified patent and that said Letters Patent is hereby corrected as shown below:

Drawings ,
Sheets 9 and 10, "TRIGGEAR" should read -- TRIGGER --.

Column 3,
Line 30, "he" should read -- the --; and
Line 61, "crosssectional" should read -- cross-sectional --.

Column 5,
Line 4, "when" should be deleted.
Line 19,"font" should read -- front --; and
Line 67, "innven-" should read -- inven- --.

Column 7,
Line 10, "fulcrum 84a" should read -- fulcrum 84a. --

Column 8,
Line 60, "he" should read -- the --.

Column 9,
Line 14, "to" should be deleted; and
Line 39, "am" should read -- cam --.

UNITED STATES PATENT AND TRADEMARK OFFICE

CERTIFICATE OF CORRECTION

PATENT NO. : 6,189,998 B1
DATED : February 20, 2001
INVENTOR(S) : Yanagi et al.

It is certified that error appears in the above-identified patent and that said Letters Patent is hereby corrected as shown below:

Column 11,
Line 4, "position example" should read -- position where the carriage 50 reverses the travel direction. With such a constitution, the wiping means (wiper) 85 may remain fixed, so that the constitution of the wiping means can be simplified. Note that the other constitution of the second example is substantially the same as that of the first example, wherein the corresponding parts are designated by like numerals, and it is not described in detail any more.

Fig. 12 is a partial front view typically showing the constitution and operation of a wiping mechanism in a third example of an ink jet recording apparatus to which the present invention is applied. While in the first example, the wiping holder 84 is attached to the pump base 25 rotatably around one and as a fulcrum, it will be appreciated that the wiping holder 84 may be moved in linear motion. In Fig. 12, a guide portion 25b is provided on the pump base 25, a wiper spring 87 is attached to the supporting shaft 84c provided on the wiper holder 84, and the wiper holder 84 is attached with the wiper spring 87 and the supporting shaft 84c extending through the guide portion 25b.

With the constitution as shown in Fig. 12, the required space can be reduced without having to lengthen the rotational arm of the wiper holder 84. The other portion in the third example as shown in Fig. 12 is substantially the same as that of the first example. --

Signed and Sealed this

Nineteenth Day of March, 2002

*Attest:*

*Attesting Officer*

JAMES E. ROGAN
*Director of the United States Patent and Trademark Office*